US008322526B2

(12) United States Patent
Kim

(10) Patent No.: US 8,322,526 B2
(45) Date of Patent: Dec. 4, 2012

(54) SHIRT BOXES AND ARRANGEMENTS OF ARTICLES OF CLOTHING THEREIN

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 0 days.

(21) Appl. No.: 12/716,458

(22) Filed: Mar. 3, 2010

(65) Prior Publication Data

US 2010/0163453 A1 Jul. 1, 2010

Related U.S. Application Data

(62) Division of application No. 12/171,574, filed on Jul. 11, 2008.

(60) Provisional application No. 60/952,934, filed on Jul. 31, 2007.

(51) Int. Cl.
*B65D 25/54* (2006.01)

(52) U.S. Cl. ..... 206/278; 206/281

(58) Field of Classification Search ..... 206/745, 206/278, 299, 282, 283, 292, 295, 297, 289, 206/293, 769, 281, 831, 8, 279; 116/234
See application file for complete search history.

(56) References Cited

U.S. PATENT DOCUMENTS

| | | | | |
|---|---|---|---|---|
| 698,266 | A | 4/1902 | Elliott | |
| 857,293 | A * | 6/1907 | Meyers | 206/49 |
| 1,271,379 | A * | 7/1918 | Sonn | 206/292 |
| 1,297,311 | A * | 3/1919 | Bacher | 248/450 |
| 1,320,933 | A * | 11/1919 | Schoenfeld | 206/292 |
| 1,398,364 | A * | 11/1921 | Davidson | 206/278 |
| 1,535,102 | A * | 4/1925 | Cohn | 206/294 |
| 1,644,963 | A * | 10/1927 | Ulich et al. | 206/278 |
| 1,697,880 | A * | 1/1929 | Peter | 206/292 |
| 1,862,353 | A | 6/1932 | Allison | |
| 1,888,301 | A * | 11/1932 | Waller | 242/222 |
| 1,913,950 | A * | 6/1933 | Platt | 206/223 |
| 1,945,792 | A * | 2/1934 | Stephens | 206/769 |
| 1,980,482 | A * | 11/1934 | Golden | 206/299 |
| 2,063,255 | A | 12/1936 | Madsen et al. | |
| 2,112,062 | A * | 3/1938 | Berger | 206/747 |
| 2,233,207 | A | 2/1941 | Gillam | |
| 2,352,427 | A * | 6/1944 | Gantt | 38/73 |
| 2,608,292 | A * | 8/1952 | Stensgaard | 206/288 |
| 2,609,629 | A * | 9/1952 | Hubbard | 40/1.5 |

(Continued)

OTHER PUBLICATIONS

U.S. Appl. No. 29/326,598, filed Oct. 21, 2008, Kim.

*Primary Examiner* — Steven A. Reynolds
*Assistant Examiner* — King M Chu
(74) *Attorney, Agent, or Firm* — Leason Ellis LLP

(57) ABSTRACT

A retail display includes a first box that includes a hollow first compartment for receiving and holding an item and a shirt that is folded and disposed within the first compartment. The display further includes a second box that is smaller than the first box and is disposed within the first compartment adjacent the folded shirt, with the second box having a base portion that includes a hollow second compartment. A neck tie is disposed within the second compartment of the second box. The neck tie includes a narrow end and an opposite broad pointed end. A transparent cover extends across and covers the first and second compartments and allows the shirt and tie to be seen by a consumer.

22 Claims, 13 Drawing Sheets

U.S. PATENT DOCUMENTS 2,686,580 A * 8/1954 Donnelly ..... 206/296
2,748,929 A * 6/1956 Iverson ..... 206/296
2,868,371 A * 1/1959 Thorpe ..... 206/278
2,973,857 A * 3/1961 Richer ..... 206/292
3,043,494 A 7/1962 Moore
3,044,605 A * 7/1962 Clement ..... 206/776
3,066,792 A * 12/1962 Spilman et al. ..... 206/299
3,081,012 A * 3/1963 Sanders ..... 206/442
3,337,030 A * 8/1967 Miller et al. ..... 206/290
3,346,881 A 10/1967 Mathison
3,362,529 A * 1/1968 Gant et al. ..... 229/125.015
3,363,264 A 1/1968 Mathison
3,511,364 A 5/1970 Airdo
3,651,929 A * 3/1972 Stoll ..... 206/778
3,670,881 A * 6/1972 Dutcher ..... 229/125.015
3,783,995 A * 1/1974 Tobin ..... 206/232
3,794,793 A * 2/1974 Rius ..... 206/760
3,899,078 A * 8/1975 Ambrozetes et al. ..... 206/335
3,908,823 A * 9/1975 Smith ..... 206/292
3,945,415 A * 3/1976 Febuary ..... 206/282
4,046,253 A 9/1977 Weaver
4,173,792 A 11/1979 Intengan
4,182,224 A 1/1980 Dutcher
4,190,151 A * 2/1980 Russell ..... 206/281
D261,479 S 10/1981 Marks
4,436,243 A * 3/1984 Nason et al. ..... 229/120.17
4,485,917 A * 12/1984 Smith ..... 206/278
4,762,272 A * 8/1988 Herrin ..... 229/125.08
4,856,709 A 8/1989 Axelsson et al.
4,933,991 A 6/1990 Love
5,135,104 A * 8/1992 Jorba ..... 206/151
D343,356 S 1/1994 Wittman
D346,960 S 5/1994 Bennett
5,316,139 A * 5/1994 Judd et al. ..... 206/278
D349,181 S 8/1994 Cheng
5,484,519 A * 1/1996 Fenton et al. ..... 206/279
5,499,484 A * 3/1996 Herrin ..... 53/458
D368,588 S 4/1996 Goraleski et al.
5,549,243 A 8/1996 Dorier et al.
5,636,746 A * 6/1997 McQueeny ..... 206/756
5,673,434 A 10/1997 Risk
D390,339 S 2/1998 Dipietro
5,740,959 A * 4/1998 Savage ..... 229/103.3
5,836,508 A * 11/1998 Savage ..... 229/103.3
5,865,013 A * 2/1999 Jackson ..... 53/474
6,012,573 A * 1/2000 Kurimoto ..... 206/278
6,041,998 A 3/2000 Goldberg et al.
6,050,403 A * 4/2000 Draney ..... 206/282
6,070,717 A * 6/2000 Philipson et al. ..... 206/45.28
6,142,365 A 11/2000 Breitbach
6,264,034 B1 * 7/2001 Bacques et al. ..... 206/497
6,427,907 B1 * 8/2002 Espinoza et al. ..... 229/122
6,460,189 B1 10/2002 Welch
D492,595 S 7/2004 Chang
6,976,613 B2 * 12/2005 Kim ..... 223/83
7,096,509 B2 8/2006 Kim
7,114,220 B2 10/2006 Kim
D546,674 S 7/2007 Limber
D553,495 S 10/2007 Vandecasteele et al.
7,310,857 B2 12/2007 Kim
D565,965 S 4/2008 Kim
D565,966 S 4/2008 Kim
D574,722 S 8/2008 Kim
D574,723 S 8/2008 Kim
D574,724 S 8/2008 Kim
D574,725 S 8/2008 Kim
D574,726 S 8/2008 Kim
D574,727 S 8/2008 Kim
D574,728 S 8/2008 Kim
D574,729 S 8/2008 Kim
D574,730 S 8/2008 Kim
7,475,654 B2 * 1/2009 Scott ..... 116/237
D589,364 S 3/2009 Kim
D589,365 S 3/2009 Kim
D589,366 S 3/2009 Kim
D589,367 S 3/2009 Kim
D590,724 S 4/2009 Kim
D590,725 S 4/2009 Kim
D590,726 S 4/2009 Kim
D593,872 S 6/2009 Kim
D593,873 S 6/2009 Kim
D595,151 S 6/2009 Kim
D596,951 S 7/2009 Kim
D596,952 S 7/2009 Kim
7,600,619 B2 * 10/2009 Sapyta ..... 190/107
D606,883 S 12/2009 Kim
2001/0052143 A1 * 12/2001 Oster ..... 2/126
2003/0034256 A1 * 2/2003 Terzian ..... 206/287
2005/0016041 A1 * 1/2005 Kim ..... 40/661.04
2005/0067443 A1 * 3/2005 Kim ..... 223/83
2007/0062846 A1 3/2007 Kim

* cited by examiner

SHIRT BOXES AND ARRANGEMENTS OF ARTICLES OF CLOTHING THEREIN

CROSS REFERENCE TO RELATED APPLICATION

The present application is a divisional of U.S. patent application Ser. No. 12/171,574, filed Jul. 11, 2008 which claims the benefit of U.S. patent application Ser. No. 60/952,934, filed Jul. 31, 2007, which are hereby incorporated by reference in their entirety.

TECHNICAL FIELD

The present invention relates to retail packaging and in particular, to shirt boxes for displaying shirts and to arrangements of articles of clothing for display in assembled boxes.

BACKGROUND

In the retail sale of dress shirts and dress shirts and tie combinations, it is desirable to present the merchandise in a manner that permits potential customers to have a good look at the product. On the other hand, it is important for retailers to keep the product clean and free of any soil or stains that may result from handling, to protect against theft, and to maintain the shirts in an orderly and well-folded condition so that their displays remains attractive to passers by.

It is also desirable that the packaging that is used be economical to manufacturer, that it be made from a recyclable material, and that it be made with minimal waste.

It is also desirable to have a packaging that addresses the foregoing needs and which permits shirts to be stacked in great number to promote efficient shelf and display space usage.

The embodiments described herein satisfy these and other needs.

SUMMARY

A retail display includes a first box that includes a hollow first compartment for receiving and holding an item and a shirt that is folded and disposed within the first compartment. The display further includes a second box that is smaller than the first box and is disposed within the first compartment adjacent the folded shirt, with the second box having a base portion that includes a hollow second compartment. A neck tie is disposed within the second compartment of the second box. The neck tie includes a narrow end and an opposite broad pointed end. A transparent cover extends across and covers the first and second compartments and allows the shirt and tie to be seen by a consumer.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
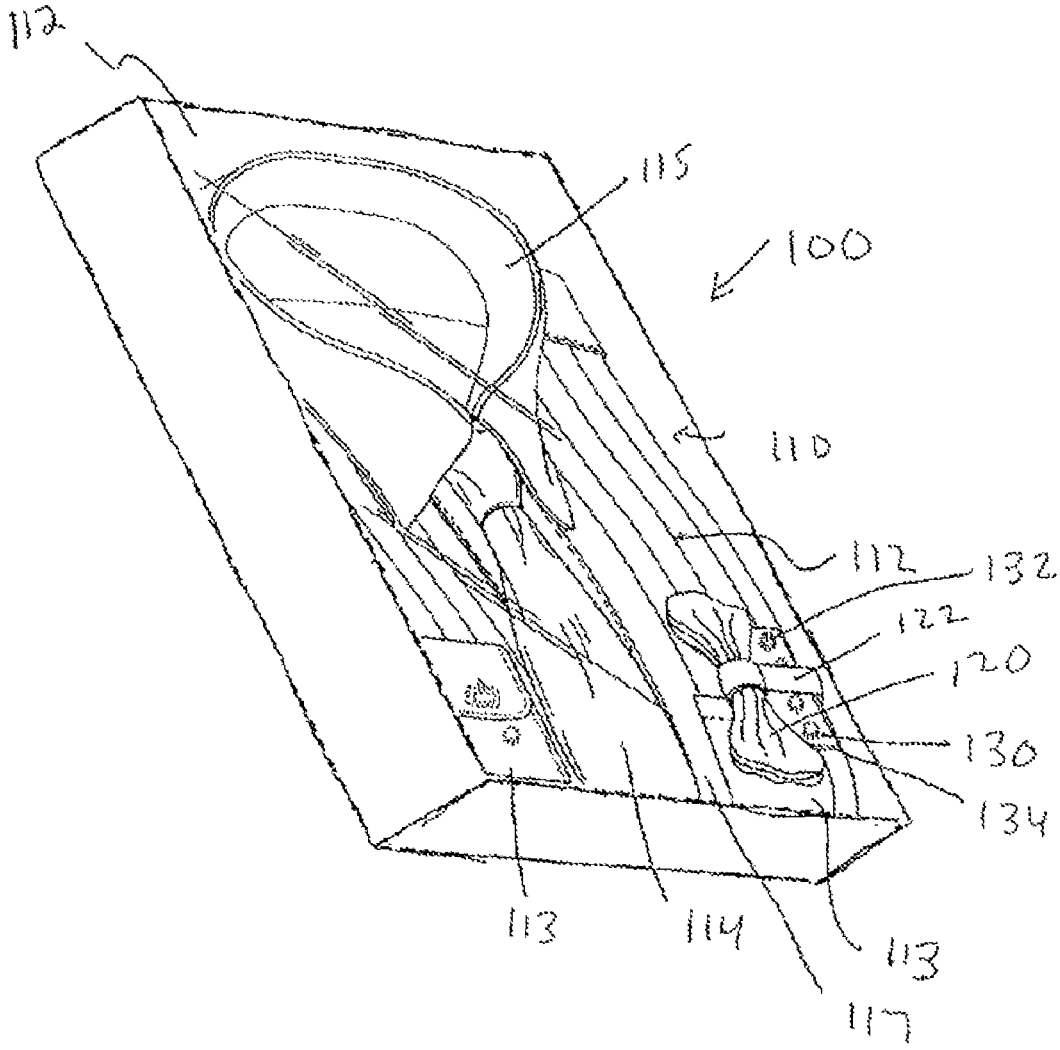
FIG. 1 is a front and side perspective view of a shirt box and arrangement of clothing according to a first embodiment of the invention.

FIG. 1 illustrates a shirt box 100 that includes a first arrangement 110 of one or more articles of clothing. The shirt box 100 can be formed to have any number of different shapes and can be formed of any number of different shapes. For example, the shirt box 100 can be constructed in the manner described in commonly assigned International Patent Application PCT/US06/34793 and U.S. patent applications 60/851,146 and Ser. No. 11/470,930, which are hereby incorporated by reference in their entireties. The shirt box 100 includes at least a transparent or semi-transparent front surface 102 through which the first arrangement 110 is visible. The front surface 102 permits the consumer to easily view the contents of the shirt box 100 during the shopping experience. In the illustrated embodiment, the box 100 has a generally rectangular shape and is formed of a clear, transparent plastic material; however, other shapes, such as trapezoidal and other materials, such as a combination of plastic and paper are equally possible.

The first arrangement 110 is in the form of a shirt 112 that is folded so as to fit within the interior of the box 100. The shirt 112 is a collared shirt and further includes a tie 114 that is displayed around the collar 115 in its normal, tied state in order to show the prospective consumer how the tie 114 looks in combination with the shirt 112. While the illustrated shirt 112 is of a formal nature (e.g., tuxedo shirt) and the tie 114 is a tie that is designed to be worn with formal wear (e.g., solid black or white color), it will be appreciated that the arrangement 110 does not have to be formal wear but instead can be an ordinary dress shirt with complementary tie.

The shirt 112 of the illustrated first arrangement 110 is folded so that the two sleeve cuffs 113 are folded over across a front body panel 117 of the shirt 112. The folded sleeve cuffs 113 are thus disposed on either side of the tie 114.

The first arrangement 110 includes a bow tie 120 that is removably attached to the shirt 112 and in particular, the bow tie 120 can include a coupling member 122, such as a clip, that attaches the bow tie 120 to one of the folded sleeve cuffs 113. The clip 122 is removable from the bow tie 120 so that once the bow tie 120 is removed from the shirt 112, the bow tie 120 can be worn around the collar 115.

The first arrangement 110 can also include accessories 130 that are removably attached to the shirt 112. The accessories 130 can be in the form of metal buttons and cuff links 132 that are provided on a substrate 134, such as a piece of cardboard. The cardboard 134 can be disposed underneath the clip 122 so as to couple the accessories 130 to the sleeve cuff 113 adjacent the bow tie 120 in a manner that permits the accessories 130 to be viewed.

Figure 2:
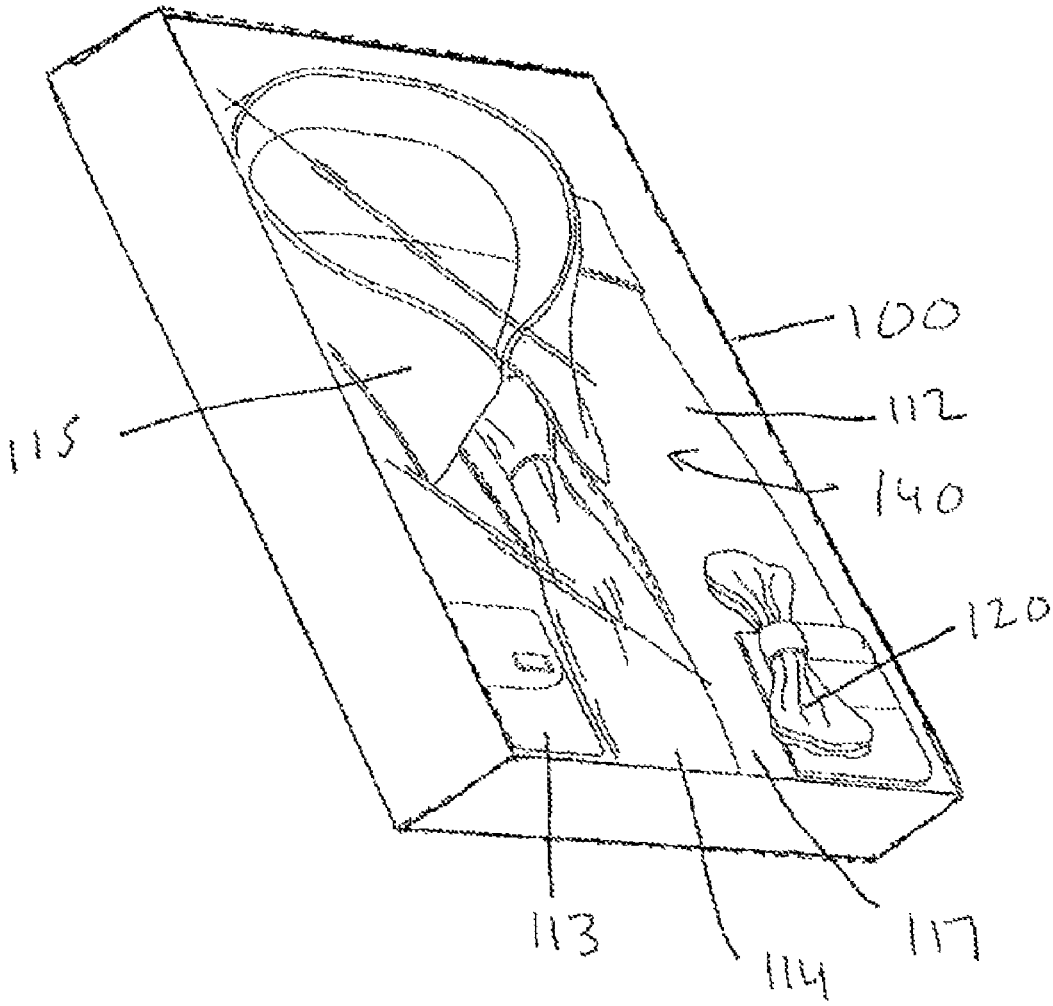
FIG. 2 is a front and side perspective view of a shirt box and arrangement of clothing according to a second embodiment of the invention.

FIG. 2 illustrates a second arrangement 140 of one or more articles of clothing for display in box 100 or any other box. The second arrangement 140 is very similar to the first arrangement 110 with the exception that the accessories 130 are eliminated.

Figure 3:
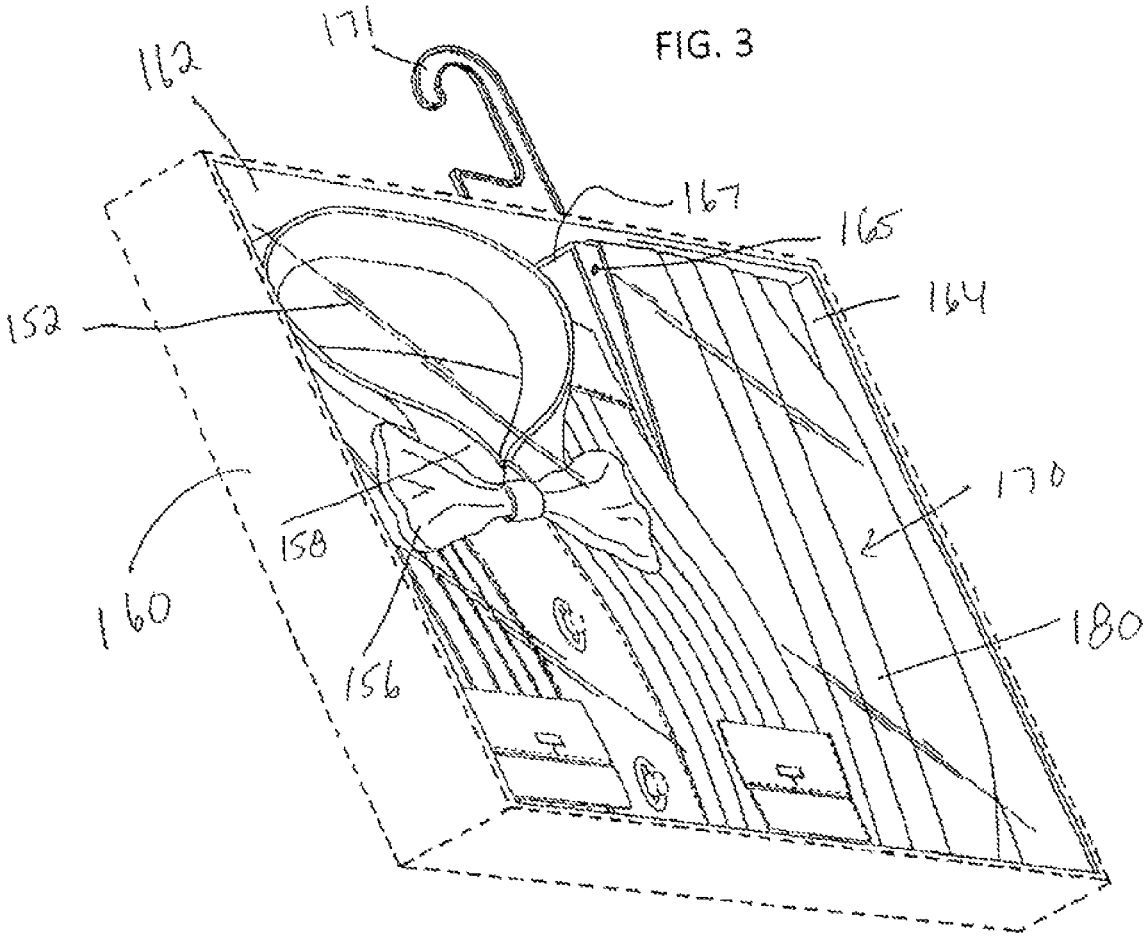
FIG. 3 is a front and side perspective view of a shirt box and arrangement of clothing according to a third embodiment of the invention.
Figure 4:
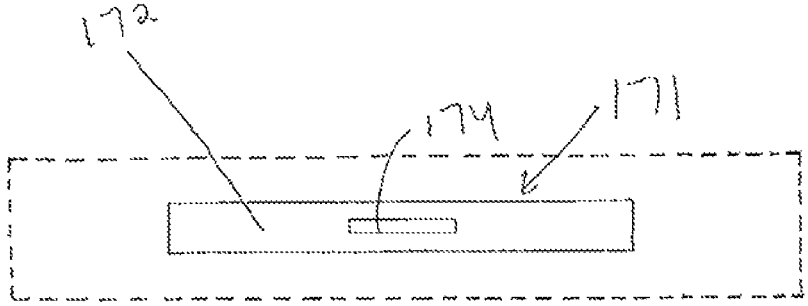
FIG. 4 is a top plan view of the box of FIG. 3.

FIGS. 3-4 illustrate a third arrangement 150 of one or more articles of clothing for display in a box 160. The box 160 is similar to the box 100 in that it has an interior to store the third arrangement 150 and includes at least a transparent front to permit viewing of the box's contents. The box 160 includes a first section 162 in which a shirt 152 is stored and a second section 164 in which one or more accessories 170 are stored.

In the illustrated embodiment, the shirt 152 is a formal shirt (e.g., tuxedo); however, it can equally be a simple dress shirt. The shirt 152 is folded for display and the sleeve cuffs 154 are folded for display also. A tie 156, such as a bow tie or regular tie, is disposed around a collar 158 of the shirt 152 in its normal wearing position.

The second section 164 is preferably formed of a planar platform 165 that is recessed relative to the side edges of the boxes but is elevated relative to the floor of the first section 162 since the accessories 170 typically have a thickness that is less than the thickness of the shirt 152. The platform 165 can be formed of a cardboard member that is inserted into the box. The platform 165 can thus have a pair of vertical walls or ends 167 that elevates the platform 165 relative to the floor of the first section 162.

In the illustrated embodiment, the platform 165 is used to display a cumberbund 180 adjacent the shirt 152. The cumberbund 180 can be wrapped around the platform component 165 so that a front portion of the cumberbund 180 is displayed through the transparent front of the box 160.

The box 160 includes a hanger 171 to permit the box 160 to be conveniently hung on a rack or the like. The hanger 171 can be of the type that includes a base section 172 and a hook portion 174 that extends upwardly from the base section 172. An underside of the base section 172 can include an adhesive layer or the like that permits the base section 172 to be attached to a top wall 165 of the box 160. The base section 172 and the hook portion 174 can be formed of a plastic material.

Figure 5:
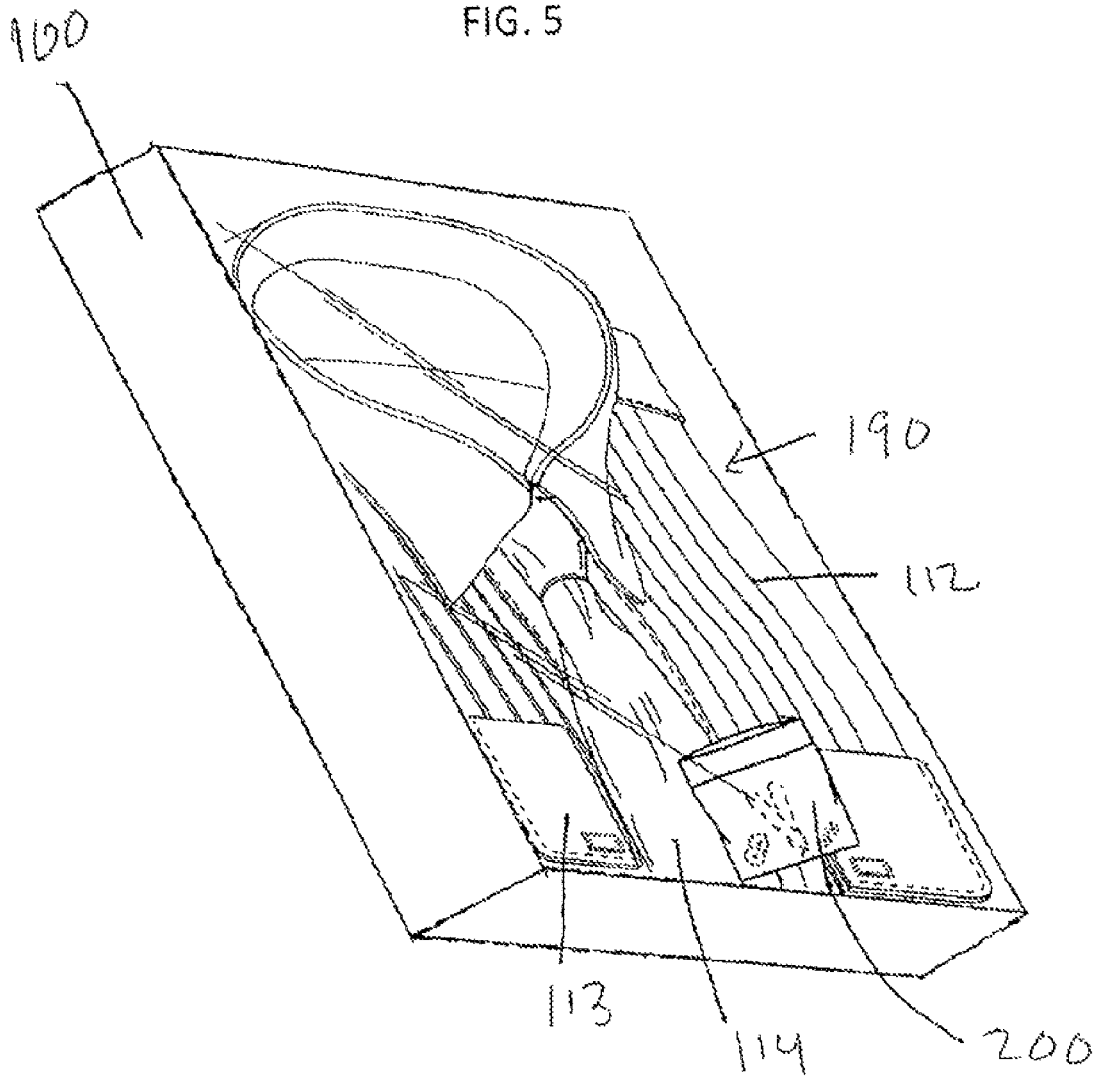
FIG. 5 is a front and side perspective view of a shirt box and arrangement of clothing according to a fourth embodiment of the invention.

FIG. 5 illustrated a third arrangement 190 of one or more articles of clothing for display in box 100. The third arrangement 190 is similar to the first arrangement 110 of FIG. 1 with the exception that the bow tie 120 and accessories 130 are eliminated. The shirt 112 is a formal shirt; however, other dress shirts can be used and the tie 114 is displayed in its normal wear position. The sleeve cuffs 113 are folded over the front panel of the shirt 112. The third arrangement 190 includes a package or bag 200 of accessories. The bag 200 of accessories includes accessories that are used with the shirt 112 and can include tie stays, buttons, etc. The bag 200 of accessories is laid across the front body panel between the sleeve cuffs 113.

Figure 6:
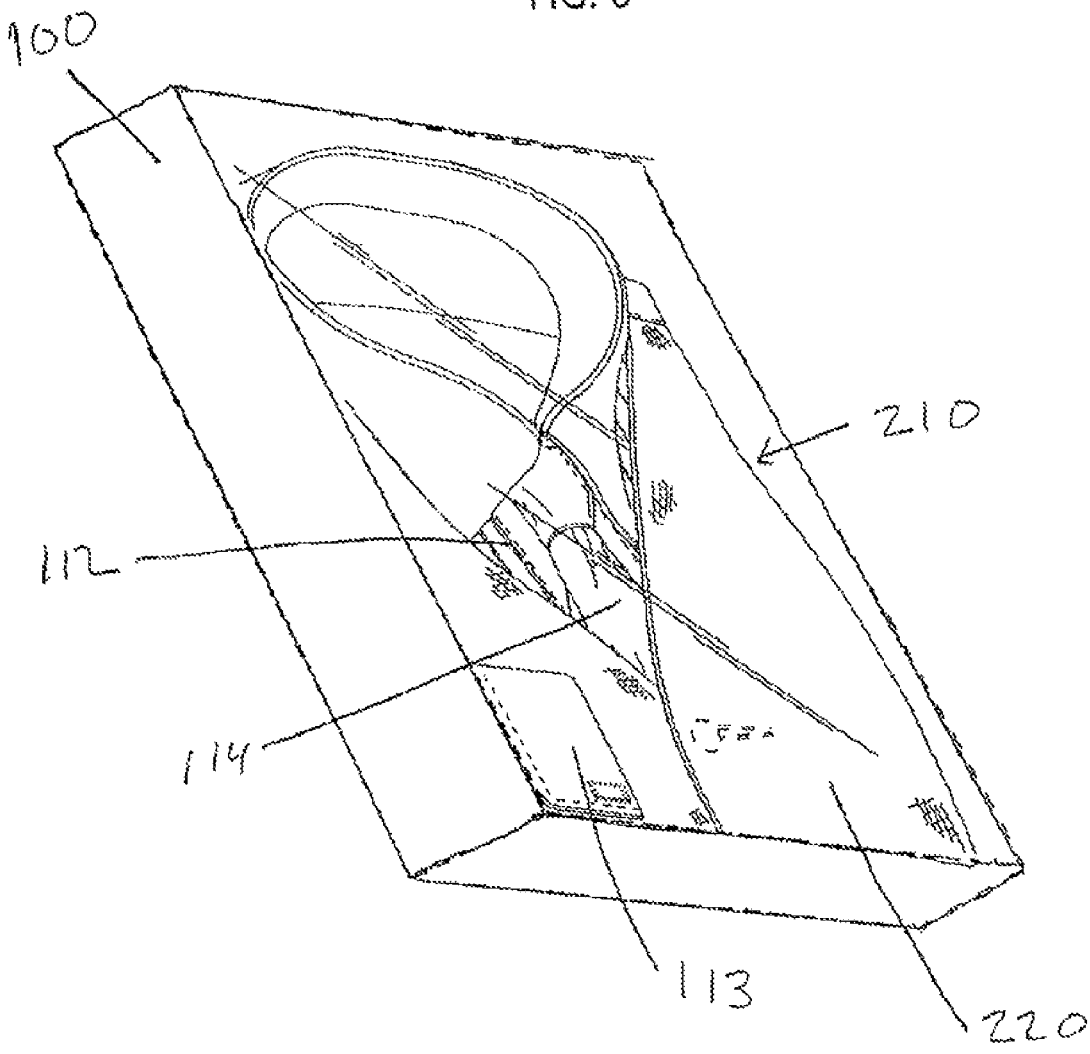
FIG. 6 is a front and side perspective view of a shirt box and arrange of clothing according to a fifth embodiment of the invention.

FIG. 6 illustrates a fourth arrangement 210 of one or more articles of clothing. The fourth arrangement 210 includes the shirt 112 and vest 220. The vest 220 is worn over the shirt 112 over the tie 114 and one sleeve cuff 113 is folded over the vest 220.

Figure 7:
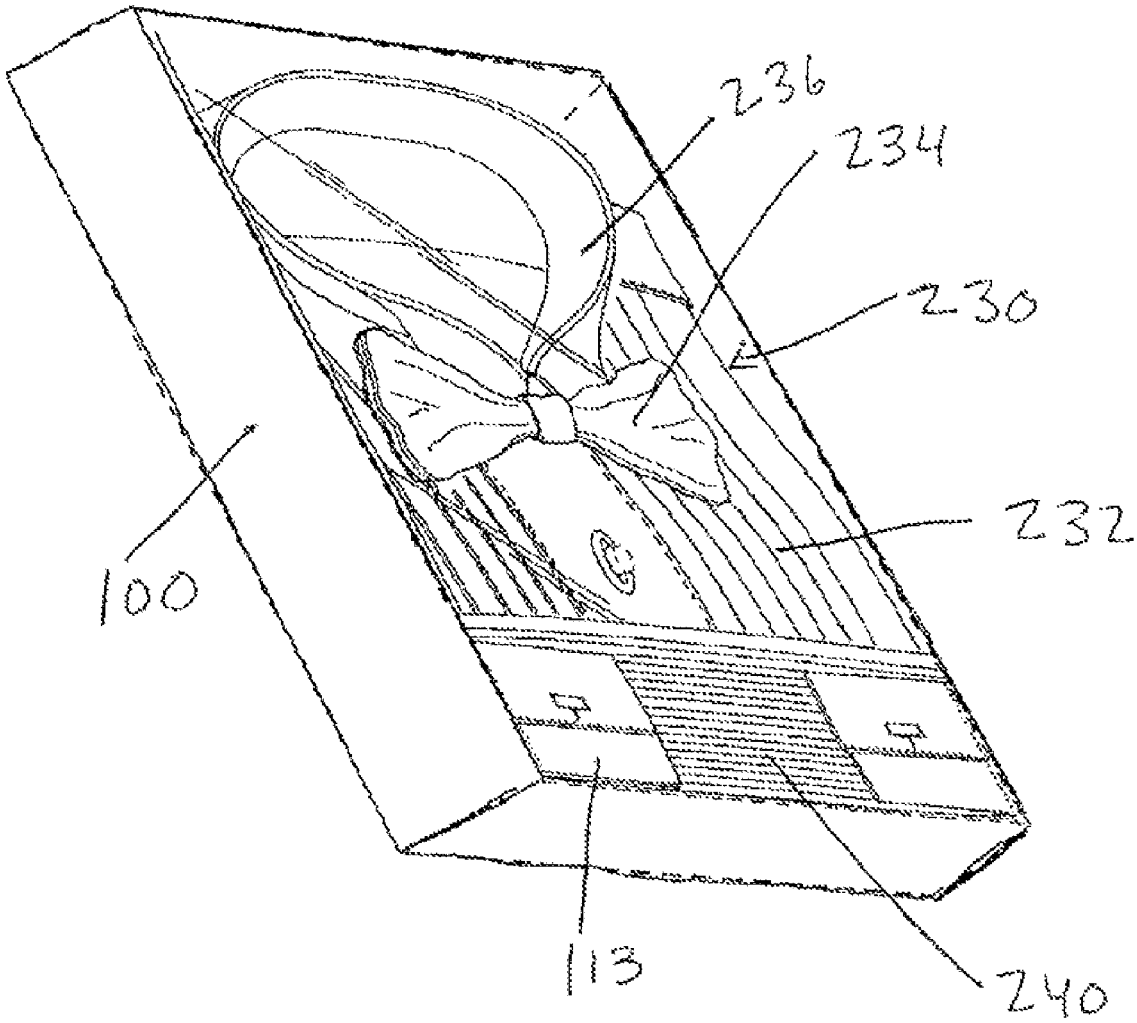
FIG. 7 is a front and side perspective view of a shirt box and arrangement of clothing according to a sixth embodiment of the invention.

FIG. 7 illustrates a fifth arrangement 230 of one or more articles of clothing for display in box 100. The fifth arrangement 230 includes a shirt 232 (formal shirt) and bow tie 234 that is worn around the collar 236 of the shirt 232. The fifth arrangement 230 includes an accessory 240 in the form of a cumberbund. The cumberbund 240 is disposed across the bottom of the folded shirt 232 with the sleeve cuffs 113 being folded over the cumberbund 240.

Figure 8:
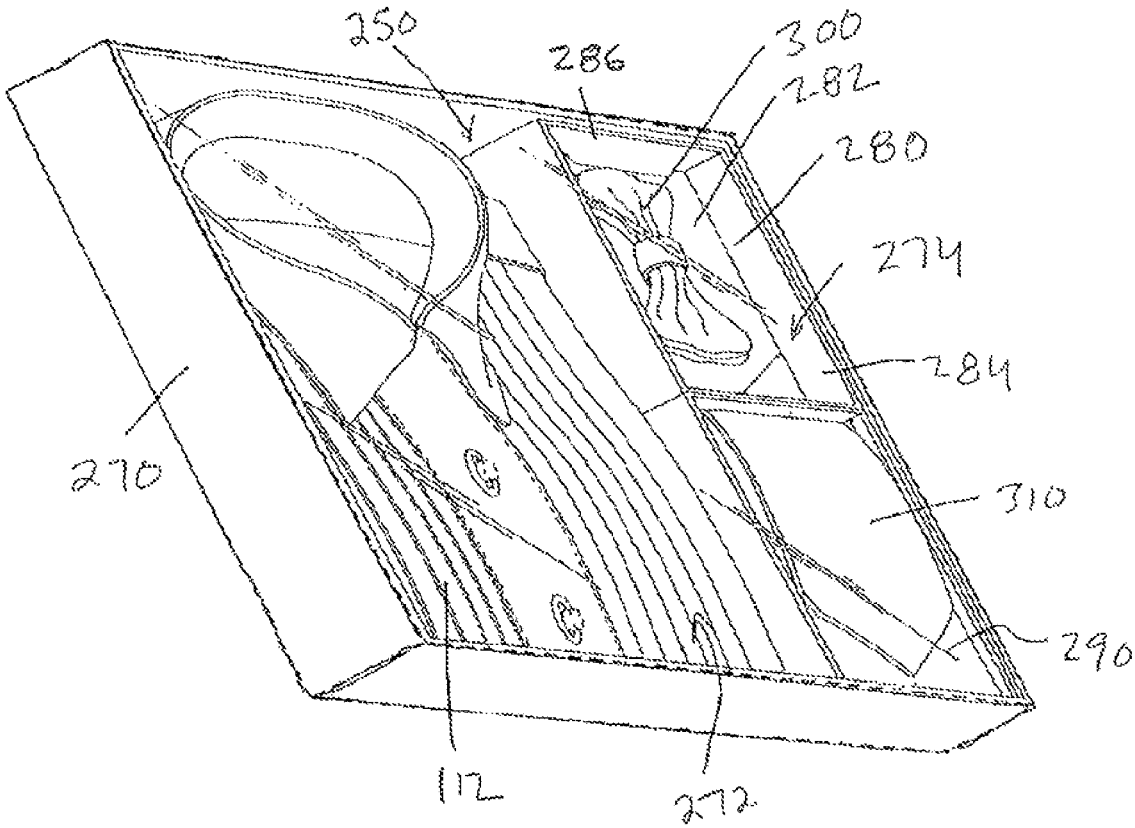
FIG. 8 is a front and side perspective view of a shirt box and arrangement of clothing according to a seventh embodiment of the invention.

FIG. 8 illustrates a sixth arrangement 250 of one or more articles of clothing for display in box 270. The box 270 includes a first section 272 that is configured to display the shirt 112 and a second section 274 that is used to display one or more accessories. A floor of the first section 272 is defined by the floor of the box 270 itself and has a greater area than the area of the second section 274 since the accessories occupy less area than the shirt 112. As with the other embodiments, the shirt 112 is folded over (e.g., folded in half) for displaying the shirt 112. The depth of the first section 272 is such that when the shirt 112 is disposed in the first section 272, the top of the shirt 112 is not compressed by the front side wall of the box 270.

In this embodiment, the second section 274 holds two separate display holders 280, 290 that hold at least two accessories which can be the same or can be different. In the illustrated embodiment, the first display holder 280 holds a first accessory 300 that is in the form of a bow tie. The first display holder 280 is in the form of a small box-like structure that includes a recessed platform or floor 282 that is surrounded by a pair of upstanding side walls 284 and a pair of upstanding end walls 286. The depth of the platform 282, as measured by the height of the side wall and wall from the platform 282 to the top edges thereof, is greater than a thickness of the bow tie so that when the bow tie 300 is placed on the platform 282, the top of the box 270 does not compress the bow tie 300. The bow tie 300 is thus compartmentalized in the first display holder 280 where it can be prominently displayed. The bow tie 300 can be anchored to the platform 282 using conventional techniques, including the use of a tie down fastener or an adhesive or the like.

In all embodiments disclosed herein that include a box, at least the front panel of the box is transparent to permit viewing of the contents of the box. In addition, a rear panel of the box can be transparent to permit viewing of the bottom of the contents. For example, the bottom can include a bottom of the folded shirt, etc.

The second display holder 290 holds a conventional neck tie 310. The second display holder 290 is described in greater detail below. As with the bow tie 300 in the first section 272, the neck tie 310 is prominently displayed in the second display holder 290. The display holders 280, 290 are stacked with respect to one another and while, the bow tie 300 is shown on top of the neck tie 310, the opposite can be true in that the bow tie 300 can be disposed below the bow tie 300.

Figure 9:
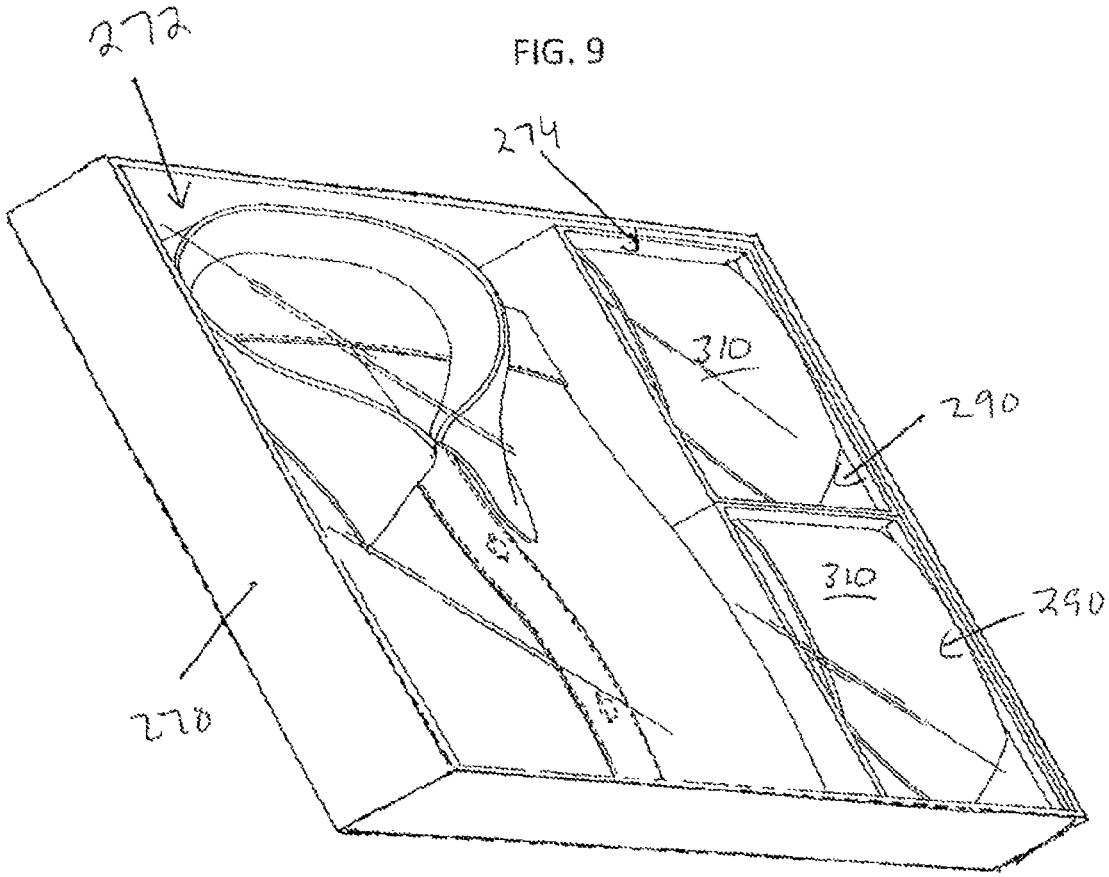
FIG. 9 is a front and side perspective view of a shirt box and arrangement of clothing according to an eighth embodiment of the invention.

FIG. 9 is similar to the embodiment of FIG. 8 with the exception that the second section 272 includes two display holders 290 for displaying two conventional neck ties 310 as opposed to one display holder 280 and one display holder 290. The two neck ties 310 are stacked on top of one another as shown.

Figure 10:
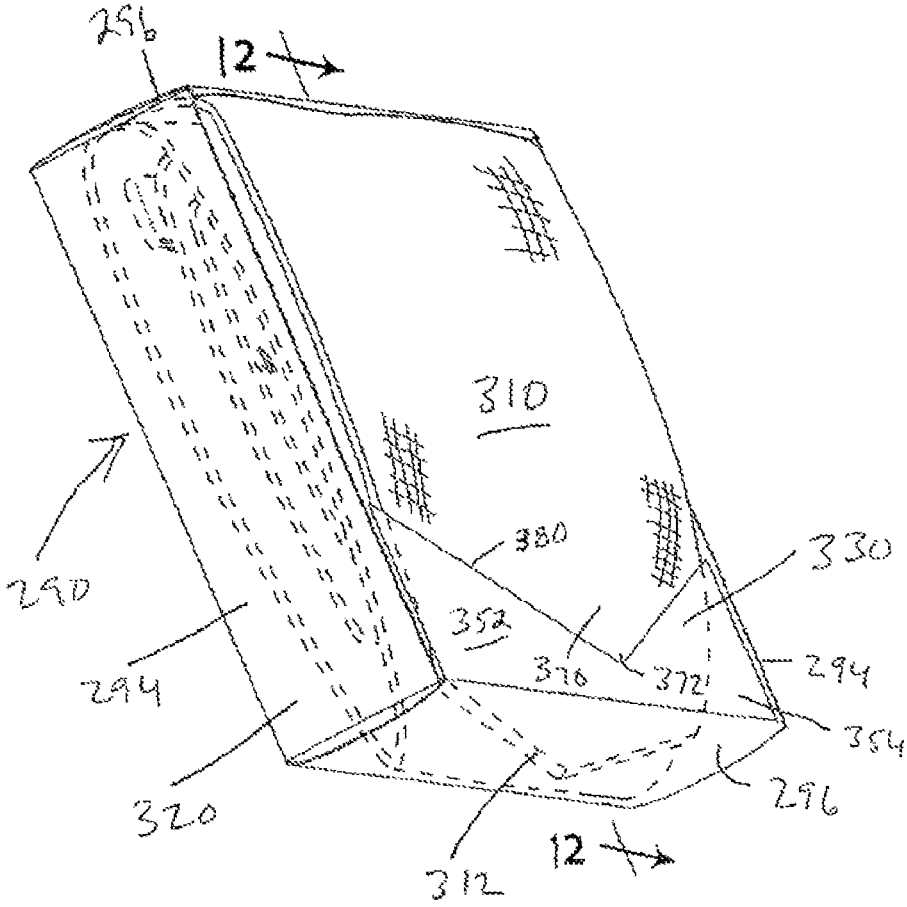
FIG. 10 is a front and side perspective view of a display holder for a neck tie for use with the box of FIG. 9.
Figure 12:
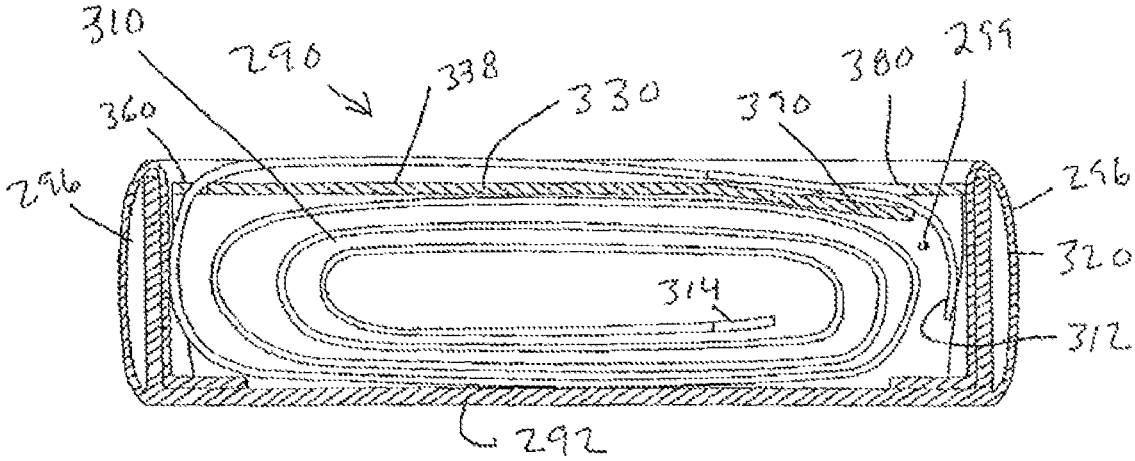
FIG. 12 is cross-sectional view taken along the line 12-12 of FIG. 11.
Figure 11:
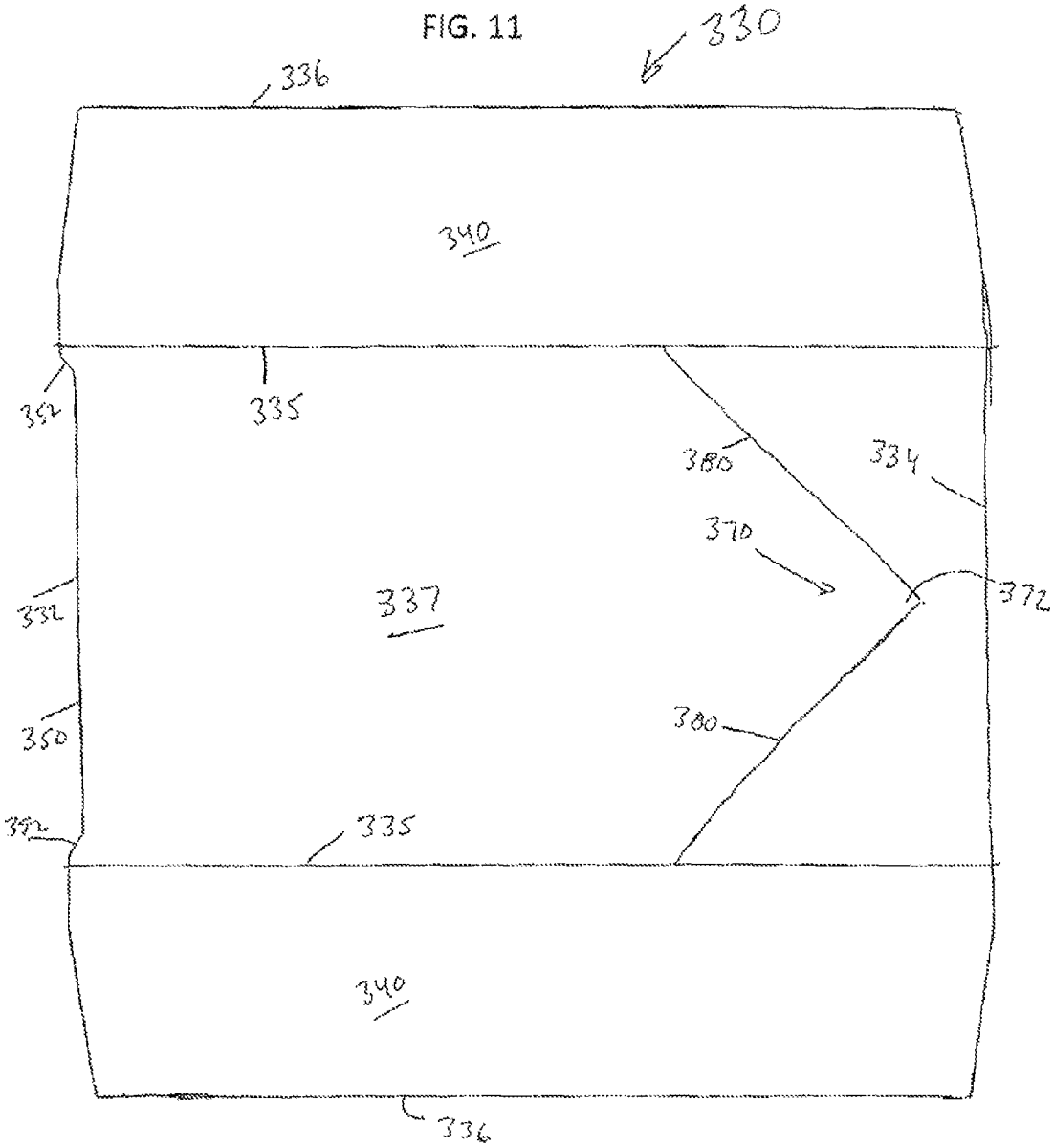
FIG. 11 is a top plan view of an insert that is part of the display holder of FIG. 10 shown in a flat, unfolded condition.

FIGS. 10-12 illustrate the display holder 290 for displaying the neck tie 310. The second display holder 290 is a box-like structure. The second display holder 290 includes a base portion 320 that is a box-like structure with an open top and also includes a tie display insert 330 that is removably received in the base portion 320.

The base portion 320 has a bottom floor or wall 292, a pair of side walls 294, and a pair of end walls 296, with the top thereof being open for receiving the neck tie 310 in a folded condition as described below. The second display holder 290 is thus generally in the form of a box structure with an interior compartment 299 being defined therein. The floor 292, side walls 294 and end walls 296 are joined together so that the display holder 290 has a generally rectangular shape.

The depth of the display holder 290, as measured from the floor 292 to top edges of the side walls 294 and end walls 296 should be sufficient to hold the neck tie 310 in a folded state as shown in FIG. 12.

Preferably, both the base portion 320 and the insert 330 are formed of a cardboard material.

The insert 330 is in the form of a folded structure that can be easily inserted and removed from the base portion 320 as shown in FIG. 11. The insert 330 initially is provided as a flat stock sheet (substrate) that has a first end 332, an opposite second end 334, and a pair of sides 336 that extend between the ends 332, 334. The insert 330 also includes a pair of fold line 335 that extend between the ends 332, 334 and create and define a middle portion 337 between the two fold lines 335.

To construct the free standing insert 330, the substrate 320 is folded about the fold lines 335 to create a free standing structure that includes a pair of legs 340 that are angled (e.g., substantially perpendicular) relative to the middle portion 337 in order to support and raise the middle portion 337 relative to the ground. Each leg 340 thus extends between one fold line 335 and one side 336 of the substrate.

The middle portion 337 has a generally rectangular shape defined by the fold lines 335 and end 332, 334 and includes a top surface 338. In contrast to the end 334, the end 332 is not a straight edge but instead has a slight cutout 350 and a pair of flared or tapered sections 352 adjacent the fold lines 335. The purpose of the cutout 350, as described in greater detail below, is that when the insert 330 is inserted into the base portion 320, the cutout 350 defines a slot or gap 360 between the insert 330 and the base portion 320.

The middle portion 337 includes a depressable tab portion 370 that is defined by a cut line or slit 380 formed in the middle portion 337. The tab portion 370 has a pointed shape and terminates in a point 372 proximate end 334. The cut line or slit 380 is generally V shaped so as to form the generally pointed shape of the tab portion 370. The cut line 380 can be thought of as being defined by two sections, each of which begins at the fold line 335 and converges toward the other line section until the two intersect at the point 372. The tab portion 370 is flexible in nature in that it can be pressed downwardly in toward the interior compartment 299 so as to provide an opening in the top surface 338 into the interior compartment 299. This opening is defined by the slit 380 and is shown in FIG. 12.

The tie 310 is preferably rolled up in order to place it into the interior compartment 299. Such a rolled up configuration is shown in FIG. 12. As is known, a conventional neck tie 310 includes a broad end 312 that is worn near the waist or belt line of the wearer and a narrow end 314 that is not visible when the neck tie 310 is worn. When rolled-up, the narrow end 314 occupies the centermost portion of the rolled up neck tie 310 since the rolling begins by holding the narrow end 314 and then wrapping the neck tie 310 in a circular manner about the narrow end 314.

The width of the tab portion 370 and the slit 380 is greater than or equal to a width of at least one section of the neck tie 310 and preferably, the width of the tab portion 370 and slit 380 are greater than the width of the broad end 312.

The neck tie 310 is contained within the display holder 290 in the following manner. First the tie 310 is wrapped a number of times around the narrow end 314 of the neck tie 310 and then the broad end 312 of the neck tie 310 is laid outside the base portion 320 with its inner surface facing upward as by draping the neck tie 310 over one end wall 296 of the base portion 320. The insert 330 is then inserted into the base portion 320 in its folded condition such that the portion of the neck tie 310 that is draped over end wall 296 is received into the cutout 350 between the pair of flared or tapered sections 352. The cutout 350 thus permits the neck tie 310 to be received between the insert 330 and the base portion 320.

It will be appreciated that the height of each leg portion 340 is such that the top surface 338 of the middle portion 337 is slightly below the top edges of the sides and ends of the base portion 320 (however it can be approximately flush therewith or even slightly above the top edges). The legs 340 are therefore disposed within the interior compartment 299 such that the folded neck tie 310 is disposed between the legs 340.

The neck tie 310, including the broad pointed end 312, is then folded back over so that the inner surface of the neck tie 310 faces the top surface 338 of the middle portion 337 of the insert 330. The broad end 312 is then fed through the slit 380 and tucked within the interior compartment 299 of the display holder 290. The broad end 312 is fed through the slit 380 by pressing the tab portion 370 downward toward the floor 292 of the display holder 290 so as to open up slit 380 so that the neck tie 310 can be received through the slit 380 and the broad end 312 can be simply contained within the interior compartment 299 of the display holder 290 with the rolled up other portions of the neck tie 310.

Because of the pointed nature of the tab portion 370 and the presence of the slit 380, an end portion 390 that is part of the middle portion 337 is defined. The end portion 390 has two substantially triangular shaped sections 352, 354 that taper inwardly and meet at a point in the center of the middle portion 337. The slit 380 is defined in part by the inward edges of the end portion 390. The neck tie 310 is thus captured between the tab portion 370 and the end portion 390.

Both the tab portion 370 and the end portion 390 are configured so that when the neck tie 310 is fed through the slit 380 by pressing the tab portion 370 downward, a pointed end appearance, generally indicated at 392, is created for the tie 310 even though the true pointed end of the neck tie 310 is not visible since it is located within the interior compartment 299, e.g., under the end portion 390.

It will be appreciated that the second display holder 290 is conveniently and cleverly constructed so that it gives the appearance that the broad end 312 of neck tie 310 is clearly visible and proximate one end wall 296 of the holder 290 when in fact the real broad end 312 of the neck tie 310 is not visible but rather is located underneath the middle portion 337 of the insert 330 within the interior compartment 299. This advantageously permits the packer or displayer of the merchandise to simply roll the neck tie 310 so that it will fit into the interior compartment 299 and then simply feed the broad end 312 of the neck tie 310 through the first slot 330. A length of the tie 310 other than the pointed broad end 312, in combination with the configured end portion 350, defines the pointed end appearance of the neck tie 310 due to the inward edges of the end portion 350 having a pointed configuration.

By forming the end portion 350 to resemble the broad pointed portion 312 of the neck tie 310, the packer of the neck tie 310 in the second display holder 310 does not have to worry about actually folding the neck tie 310 so that the broad end 312 is displayed across the top surface of the middle portion 337 near one end wall 296 of the base portion 320, which would be a tedious and time consuming task. Instead, any section of the neck tie 310 can be made to have the appearance of the broad pointed end 312 by simply feeding the neck tie 310 through the insert 330 and then placing the insert 330 into the base portion 320 in its upright condition around the neck tie 310. The insert 330 thus closes off the open top portion of the base portion 320.

In the illustrated embodiment, the first and second display holders 280, 290 have the same size with each occupying ½ of the area of the second section 274. Each of the display holders 280, 290 has a generally rectangular shape; however, other shapes, such as square, are equally possible.

Figure 13:
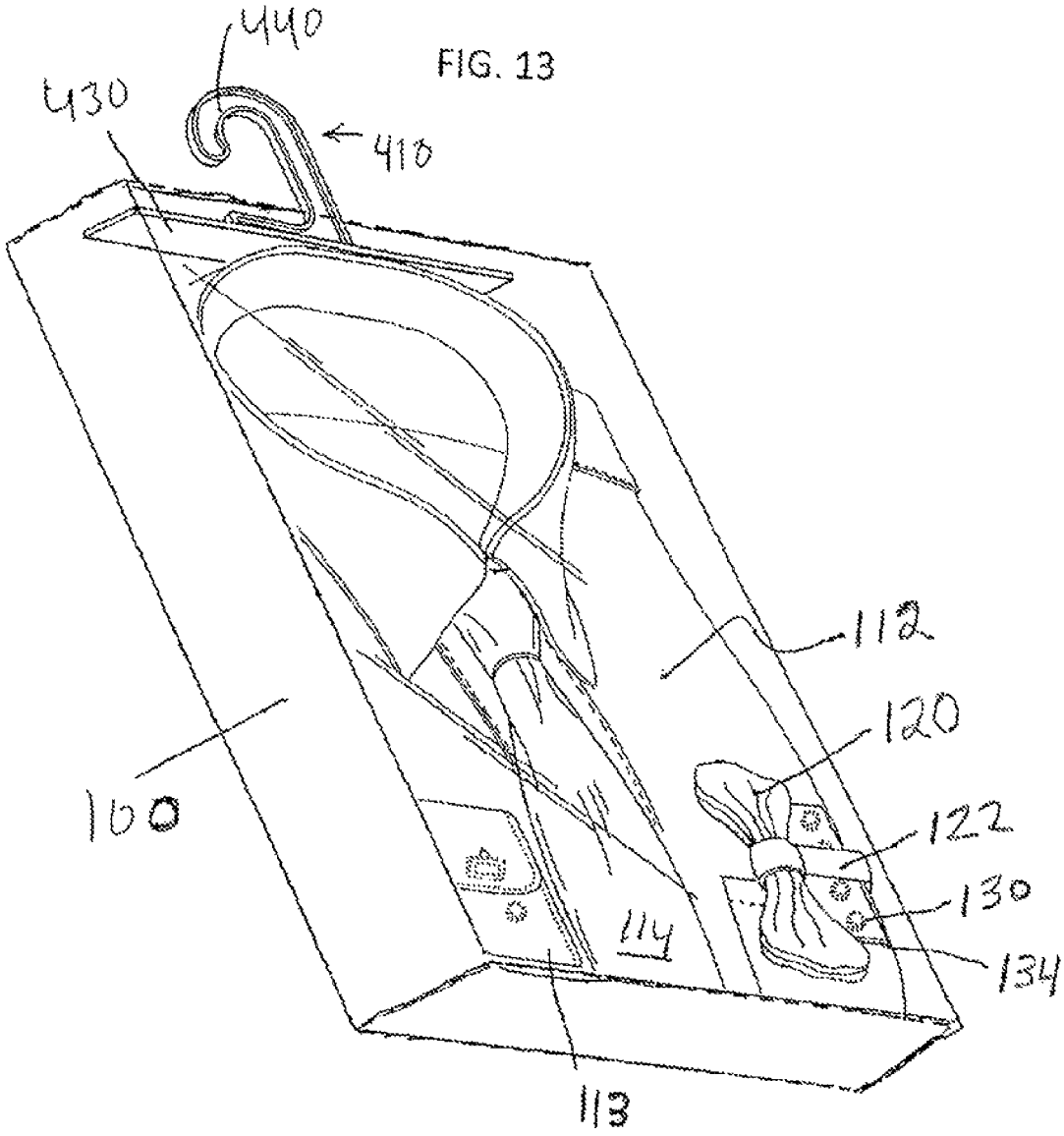
FIG. 13 is a front and side perspective view of a shirt box and arrangement of clothing according to a ninth embodiment of the invention.
Figure 14:
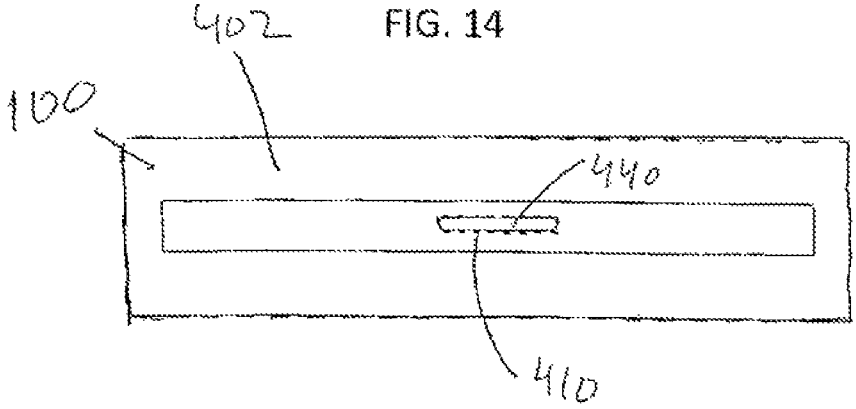
FIG. 14 is a top plan view of the box of FIG. 13.

FIGS. 13 and 14 illustrate another box 400 for displaying the arrangement 110. The box 400 includes a slot 410 that is formed in the top wall 402 of the box 400. A hanger 420 is provided for use with the box 400 to permit the box 400 to hang. The hanger 420 includes a base portion 430 and a hook member 440 that extends outwardly from the base portion 430. The hook member 440 is sized to be received through the slot 410 in the top wall 402. The base portion 430 is disposed adjacent the underside of the top wall 402.

Figure 15:
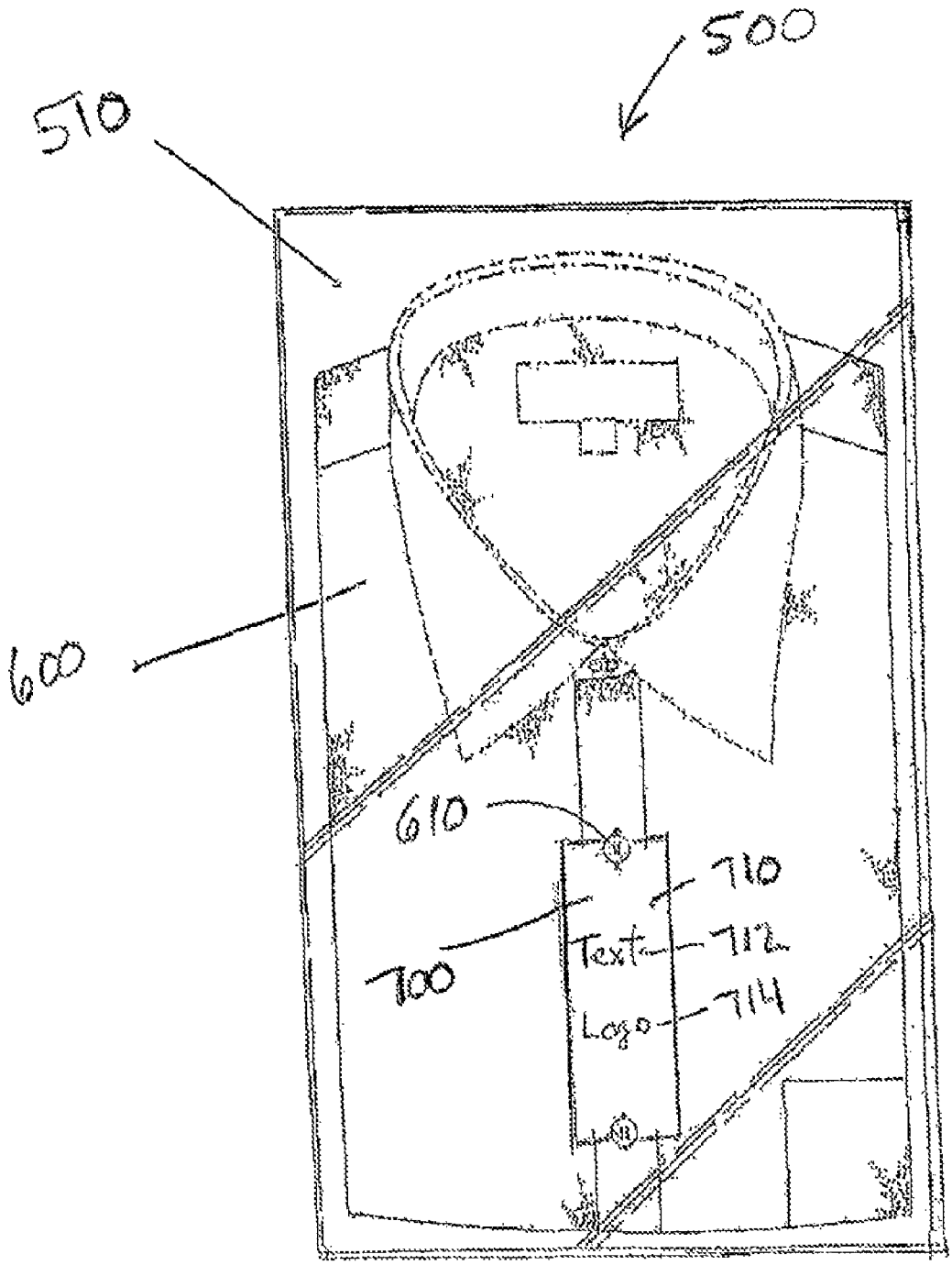
FIG. 15 is a front elevation view of a box including a shirt and an indicator securely coupled to buttons of the shirt.
Figure 16:
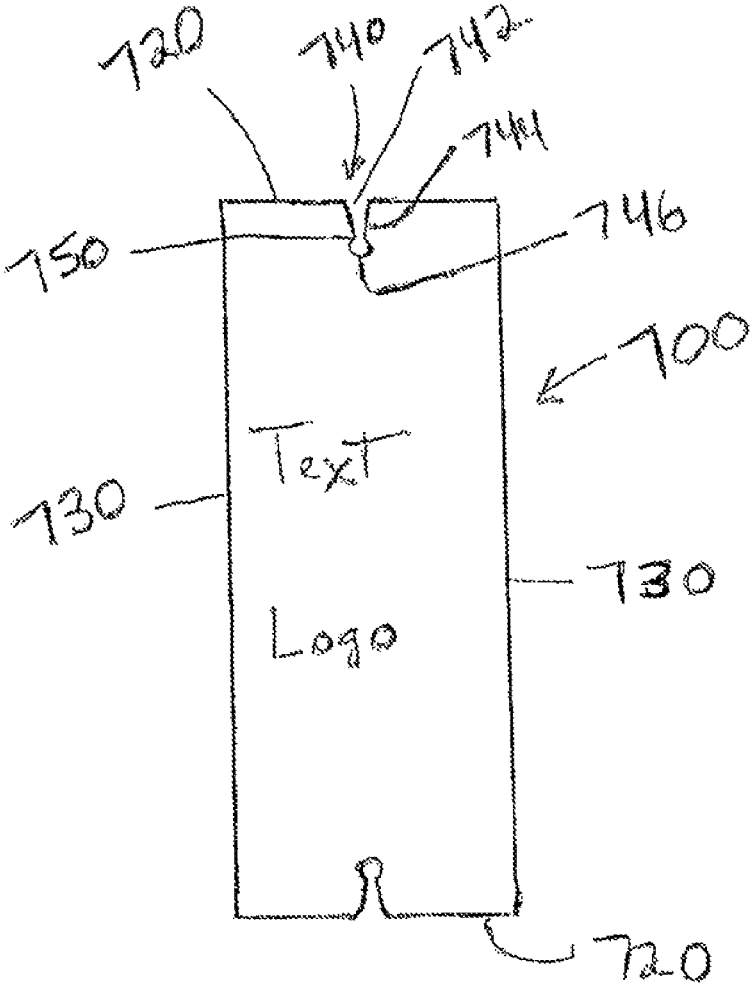
FIG. 16 is a front elevation view of the indicator of FIG. 15.

Now turning to FIGS. 15-16 in which another aspect of the present invention is shown. FIG. 15 shows a box 500 similar or identical to the other boxes shown herein. The box 500 at least includes a front transparent panel 510 through which the contents of the box 500 can be viewed. The other panels of the box 500 can be transparent. In particular, the rear panel can be transparent to allow the bottom of the folded shirt to be visible. Similarly, the ends and sides of the box 500 can be transparent or they can be opaque.

While box 500 is only shown having the shirt 600 included therein, it will be appreciated that other accessories can be included in the box 500. For example, one or more ties (see FIG. 9) can be disposed within the box 500 adjacent the folded shirt 600. The tie(s) can be located along one side of the folded shirt 600 or can be located along either the top or bottom.

The shirt 600 is in a folded position within the box 500.

Figure 17:
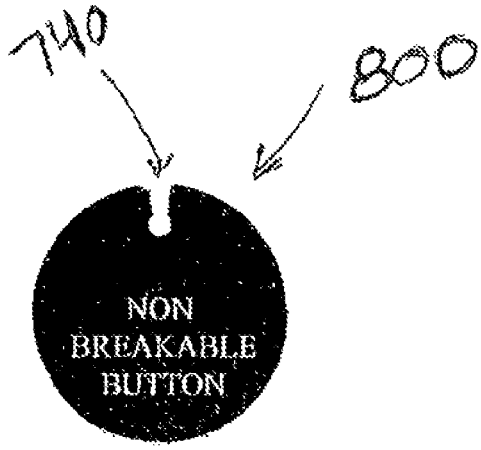
FIG. 17 is a front elevation view of an indicator according to another embodiment.

In accordance with this embodiment, an indicator or tag 700 is provided for attachment to the shirt 600. The indicator 700 is designed to be detachably coupled to one or more buttons 610 of the shirt 600 and provides an indicia display surface 710. The indicia display surface 710 can include text 712 and/or a logo 714. For example, the text 712 can read "Non Breakable Button"as shown in FIG. 17. When used in this manner, the indicator 700 alerts consumers to the fact that the buttons 610 of the shirt 600 are of the non breakable type. The indicator 700 thus serves as an attractive means for advertising the feature to which the indicator 700 is actually attached. The indicator 700 thus draws the consumer's attention to the buttons 610 and displays information that relates to the construction of the buttons 610. Other indicia, such as a corporate logo 714 or product name, can be provided on the indicator 700.

In one embodiment, the indicator 700 is designed to be attached to and between two buttons 610 as shown in FIG. 15. The indicator 700 has a rectangular shape defined by a pair of end walls 720 and a pair of side walls 730. Along the end walls 720, a coupling notch 740 is formed for detachably attaching the indicator 700 to button 610. The notch 740 includes an entrance portion 742 that has a first width and leads to a locking portion 746 in which the button 610 is securely located and held. The entrance portion 742 is slot defined by inwardly tapered side edges 744 and therefore, the width of the entrance portion 742 progressively gets smaller in a direction toward the locking portion 746.

A neck portion 750 is defined at the interface between the entrance portion 742 and the locking portion 746. The neck portion 750 defines the minimum width of the notch 740. The locking portion 746 is in the form of a circular opening that is designed to receive the thread or other means for securing the button 610 to the shirt 600.

One type of button 610 is a sew-through button that has two or four holes punched through the button through which thread is sewn to attach the button. Since the thread passes through each hole, a number of individual thread sections (e.g., 4) are located next to one another to form a stem like structure that anchors the button 610 to the shirt 600 but permits movement and manipulation of the button 610 relative to the shirt 600 to allow the button 610 to be used to securely attach one shirt panel to the other.

A thickness of the indicator 700 is such that it is received between the button 610 and the shirt 600.

The indicator 700 is sized and constructed so that it can be attached to and between two adjacent, vertically oriented buttons 610 resulting in the indicator 700 being vertically held along the front of the shirt 600.

Since the indicator 700 is typically made of a flexible material, such as cardboard or even a thin plastic, it can flex.

The method of attaching the indicator 700 to the shirt 600 is now described. The indicator 700 is oriented so that the text 712 and/or logo 714 faces outward and then one end wall 720 is positioned relative to the button 610. The threads that attach the button 610 to the shirt 600 are aligned with the entrance portion 742. The end 720 is positioned underneath the button 610 and pushed in a direction causing the threads to enter the notch 740.

The width of the bundle of threads is less than the widest portion of the entrance portion 742 but is less than the width of the neck portion 750 and therefore, the bundles of threads can easily be inserted into and be guided within the entrance portion toward the locking portion 746. At a point prior to or art the neck portion 750, the width of the bundles of threads is greater than the width of the notch 740 and therefore, further movement of the bundle towards the locking portion 746 results in the indicator 700 flexing to accommodate the bundle. This allows the bundle to clear the neck portion 750 and enter the locking portion 746 which has a diameter (width) greater than the width of the bundle and therefore, the bundle is maintained in the locking portion 746. The bundle is effectively captured in the locking portion 746 since the neck portion 750 has a width less than the bundle of threads and therefore, the bundle of threads can not simply migrate from the locking portion 746 to the entrance portion 742.

After securely attaching one end 720 of the indicator 700, the process is repeated at the other end 720 of the indicator 700 resulting in both ends 720 of the indicator 700 being attached to two buttons. The button thus carries the indicator in each embodiment.

FIG. 18 illustrates an indicator 800 that is similar to indicator 700 with the exception that the indicator 800 is meant to only be attached to a single button. Indicator 800 thus includes only a single notch 740 for coupling the indicator 800 to the button. The construction of the notch 740 is the same as in the indicator 700. The shape of the indicator 800 can vary and is not limited to the circular shape shown. For example, indicator 800 can have a square shape, triangle shape, oval shape, etc.

In addition, while the indicators 700, 800 have been described as being attached to the buttons 610 along the front panel of the shirt, the indicators 700, 800 can be attached to buttons that are located along the sleeves (cuffs) of the shirt.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A retail display comprising:

a first box that includes a hollow first compartment for receiving and holding an item, the first box having a bottom surface;

a shirt that is folded and disposed within a first section of the first compartment;

a second box that is smaller than the first box and is separate and removable relative to the first box, the second box being disposed only within a second section of the first compartment on and across the bottom surface adjacent the folded shirt such that the second box is disposed between one side of the first box and the folded shirt, the folded shirt being disposed only within the first section, the second box having four side walls that define a completely enclosed structure and including a base portion that includes a hollow second compartment, wherein a location of the second box within the first box can be varied due to the second box being movable relative to the first box, wherein one side wall of the second box spaces the folded shirt from the side of the first box;

a neck tie that is disposed within the second compartment of the second box, the neck tie including a narrow end and an opposite broad pointed end, the second compartment of the second box only containing one neck tie, the neck tie being folded within the second box; and a transparent cover that extend across and covers the first and second compartments and allows the shirt and tie to be seen by a consumer;

wherein the second box further includes an insert that is disposed above a portion of the folded neck tie and has a slit formed through which a portion of the neck tie passes such that the broad pointed end of the tie is disposed underneath the insert, wherein the slit is shaped such that the portion of the neck tie that passes through the slit has a pointed tie appearance that resembles the broad pointed end of the tie which is located underneath the insert and not visible.

2. The display of claim 1, wherein the base portion of the second box is open along a top thereof and the insert has a pair of upstanding leg portions and a top wall that extends between the upstanding leg portions, the top wall having the slit formed therein and defines a depressable tab portion, the slit having a pointed shape, the insert being inserted into the base portion such that the neck tie is disposed between the upstanding leg portions and a space is formed between a first end of the insert and one end wall of the base portion through which the neck tie extends and is folded across the top wall and through the slit such that the broad pointed end of the tie is disposed with the compartment of the base portion underneath the insert.

3. The display of claim 2, wherein the base portion and the insert are formed of a paper material.

4. The display of claim 2, wherein the insert is formed of a paper substrate that includes two longitudinal fold lines that define the leg portions and the top wall.

5. The display of claim 2, wherein a pointed end of the slit is proximate a second end of the insert opposite the first end.

6. The display of claim 2, wherein the first end of the insert includes a cut-out section formed in the top wall that defines the space through which the neck tie extends when the insert is inserted into the base portion.

7. The display of claim 6, wherein ends of the cut-out section are defined by a pair of beveled edges that intersect where the top wall joins the upstanding leg portions.

8. The display of claim 2, wherein the tab portion has a generally triangular shape.

9. The display of claim 2, wherein a height of the leg portions is less than a height of the side walls of the base portion so as to position the top wall below the top edges of the base portion.

10. The display of claim 2, wherein the slit is generally V-shaped.

11. The display of claim 2, wherein the end section of the top wall is defined by a pair of generally triangular shaped sections formed between the slit and a second end of the insert.

12. The display of claim 1, further including:

a third box that is smaller than the first box and is disposed within the first compartment on the bottom surface adjacent the folded shirt and adjacent the second box, the third box having a base portion that includes a hollow third compartment, the third box being separate and removable relative to the first box and the second box, wherein a location of the third box within the first box and relative to the second box can be varied due to the third box being movable relative to the first and second boxes; and a neck tie that is disposed within the third compartment of the third box, the neck tie including a narrow end and an opposite broad pointed end;

wherein the transparent cover extends across and covers the third box.

13. The display of claim 12, wherein the second and third boxes are arranged along one side wall of the first box.

14. The display of claim 1, wherein the shirt comprises a collared shirt.

15. The display of claim 12, wherein the second and third boxes are the same.

16. The display of claim 1, further including a third box that is smaller than the first box and is disposed within the first compartment on the bottom surface adjacent the folded shirt and adjacent the second box, the third box having a base portion that includes a hollow third compartment; and a clothing accessory disposed within the hollow third compartment, the third box being separate and removable relative to the first box and the second box, wherein a location of the third box within the first box and relative to the second box can be varied due to the third box being movable relative to the first and second boxes.

17. The display of claim 1, wherein the shirt has a plurality of buttons, each button being secured to the shirt with thread and the display further includes an indicator that is constructed to be detachably attached to at least one button, the indicator having an outer surface for displaying indicia and a locking notch for receiving the thread and causing the indicator to be attached to the button, the notch having an entrance portion that has a variable width and a locking portion at a closed end of the notch, with a neck portion being formed at an interface between the entrance portion and the locking portion where a width of the notch is at a minimum and is greater than a width of the thread that attaches the button to the shirt, wherein in an attached position, the thread is captured within the locking portion with the neck portion preventing detachment of the indicator from the button.

18. The display of claim 17, wherein the indicia is text that indicates a material characteristic of the button to which the indicator is attached.

19. The display of claim 17, wherein indicator has two notches formed along two opposing edges of the indicator and the indicator is attached between two spaced buttons.

20. The display of claim 19, wherein the two spaced buttons are part of a front panel of the shirt and the indicator is vertically oriented along the front panel of the shirt.

21. The display of claim 17, wherein the entrance portion is defined by a pair of inwardly tapered side edges and the locking portion is a circular shaped opening.

22. The display of claim 17, wherein the button is formed along one of the front shirt panel and a cuff of the shirt.

* * * * *